US009398385B2

(12) United States Patent
Schneider et al.

(10) Patent No.: US 9,398,385 B2
(45) Date of Patent: Jul. 19, 2016

(54) FITTING SYSTEM AND METHOD FOR FITTING A HEARING SYSTEM

(75) Inventors: Philipp Schneider, Zurich (CH); Ullrich Sigwanz, Hombrechtikon (CH)

(73) Assignee: SONOVA AG, Staefa (CH)

( * ) Notice: Subject to any disclaimer, the term of this patent is extended or adjusted under 35 U.S.C. 154(b) by 403 days.

(21) Appl. No.: 13/583,058

(22) PCT Filed: Mar. 16, 2010

(86) PCT No.: PCT/EP2010/053400

§ 371 (c)(1), (2), (4) Date: Sep. 6, 2012

(87) PCT Pub. No.: WO2010/072845

PCT Pub. Date: Jul. 1, 2010

(65) Prior Publication Data

US 2013/0024798 A1 Jan. 24, 2013

(51) Int. Cl.
*H04R 29/00* (2006.01)
*H04R 25/00* (2006.01)

(52) U.S. Cl.
CPC ..... *H04R 25/70* (2013.01); *H04R 25/30* (2013.01); *H04R 25/558* (2013.01)

(58) Field of Classification Search
USPC ..... 381/60, 314
See application file for complete search history.

(56) References Cited

U.S. PATENT DOCUMENTS 8,577,049 B2 * 11/2013 Soelberg ..... A63F 13/10 381/314
8,767,986 B1 * 7/2014 Fabry ..... H04R 25/70 381/314
2004/0071296 A1 * 4/2004 Wasden ..... 381/60
2005/0114825 A1 * 5/2005 Leung et al. ..... 717/100

FOREIGN PATENT DOCUMENTS

EP 1091620 A1 4/2001
WO 2005/096732 A2 10/2005

OTHER PUBLICATIONS

International Search Report for PCT/EP2010/053400 dated May 18, 2011.
Written Opinion for PCT/EP2010/053400 dated May 18, 2011.

* cited by examiner

*Primary Examiner* — Amir Etesam
(74) *Attorney, Agent, or Firm* — Pearne & Gordon LLP

(57) ABSTRACT

The method for adjusting a hearing system to individual hearing needs and preferences of a specific hearing system user by means of a fitting system comprising a visual display comprises:

a) presenting on the visual display a visualization (33) simultaneously visualizing
for each of a group of data sets: whether or not the respective data set is accessible to a user of said fitting system; and
for each device selected in said fitting system to be part of said hearing system: whether or not the respective device is accessible to a user of said fitting system;

by b1) displaying on the visual display a graphics object (33*a*, 33*b*, . . . ) representing the respective data set or device, in case the respective data set and the respective device, respectively, is accessible to a user of said fitting system; and b2) not displaying on said visual display a graphics object (33*a*, 33*b*, . . . ) representing the respective data set or device, in case the respective data set and the respective device, respectively, is not accessible to a user of said fitting system.

19 Claims, 5 Drawing Sheets

FITTING SYSTEM AND METHOD FOR FITTING A HEARING SYSTEM

TECHNICAL FIELD

The invention relates to the field of hearing devices, and in particular to the fitting of hearing devices. It relates to methods and apparatuses according to the opening clauses of the claims.

Under a hearing device, a device is understood, which is worn in or adjacent to an individual's ear with the object to improve the individual's audiological perception. Such improvement may also be barring acoustic signals from being perceived in the sense of hearing protection for the individual. If the hearing device is tailored so as to improve the perception of a hearing impaired individual towards hearing perception of a normal-hearing individual, then we speak of a hearing-aid device. With respect to the application area, a hearing device may be applied, e.g., behind the ear (BTE), in the ear (ITE), completely in the ear canal (CIC) or may be implanted.

A hearing system comprises at least one hearing device. In case that a hearing system comprises at least one additional device, all devices of the hearing system are operationally connectable within the hearing system. Typically, said additional devices such as another hearing device, a remote control or a remote microphone, are meant to be worn or carried by said individual.

BACKGROUND OF THE INVENTION

A hearing device is of very limited use for a hearing device user if it is not specifically adjusted to the hearing needs and preferences of the hearing device user. This applies in particular to hearing-aid devices.

The corresponding individual adjusting is referred to as "fitting".

In many cases, in particular when it comes to hearing-aid devices, the fitting can be roughly divided into two phases. In a first phase, a fitting rationale is applied to an audiogram of the hearing device user and possibly additional data. The result can be referred to as baseline-fitting or initial fitting or first-fitting. A fitting rationale such as Phonak Adaptive Digital, NAL-NL1, DSL-[i/o] or others, can be considered an algorithm that can be fed with audiogram data and possibly additional data, whereupon it outputs parameter settings, more particularly transfer curves such as a multitude of frequency-dependent amplifications for various input levels or the like. Adjusting the hearing device according thereto, will usually result in a relatively good initial fitting (good initial parameter settings), but many further adjustments are usually necessary for a satisfactory hearing experience.

These further adjustments, making up the second fitting phase, is referred to as "fine-tuning". Fine-tuning requires a lot of experience and time and therefore patience from both, the hearing device user and the fitter.

Today, the fitting or at least the fine-tuning is carried out by means of a fitting software running on a computer system. A fitting system usually comprises that computer system with said fitting software and, usually, also some interfaces and the hearing system to be fitted itself.

The fitting and in particular the fine-tuning process is rather complicated, in particular due to rather complex interdependencies, e.g., interdependencies between various fitting parameters, interdependencies between fitting parameters and properties of the hearing system, and interdependencies between fitting parameters and data related to the hearing system user and his hearing, respectively.

Current fitting software employs the well-known techniques of toolbars, menus, drop-down lists, pop-up boxes, wizards and the like. E.g., sequential dependencies are reflected in a wizard, which guides the user of the fitting system through a rigid process flow. Or a dependency is reflected in a pop-up box informing the user of the fitting system of the dependency, thus allowing the user of the fitting system to consider that dependency when editing data; or the pop-up box (a pop-up box being a modal dialog blocking the application) requests the user of the fitting system to make a decision how to treat a potential conflict.

There exists fitting software which offers the presentation of "histories" or "summaries" of "fitting overviews" by means of which the user of the fitting system shall gain some overview over the fitting process so far. By means of these, all actions taken and all potential or real conflicts are presented to the user of the fitting system.

SUMMARY OF THE INVENTION

The inventors have recognized that today's fitting software employing the before-described techniques have several drawbacks. In particular, the flow of thoughts of the user of the fitting system is interrupted very often. A calm, concentrated, thoughtful proceeding during the fitting is thus strongly impeded. And the fitter is not really provided with an overview over the current situation and status in the fitting process, at least not without accepting another interruption of his thoughts.

E.g., a pop-up box virtually always interrupts the train of thoughts, in particular if a decision or another input is requested, and even more pronouncedly when the input concerns parameters or aspects different from those currently worked on. A rigid process flow prescribed by a wizard usually does not allow to carry out other amendments the user of the fitting system might prefer to carry out in the meantime.

Therefore, one object of the invention is to create a way of fitting a hearing device that does not have the disadvantages mentioned above.

A method for manufacturing an adjusted hearing system adjusted to individual hearing needs and preferences of a specific hearing system user shall be provided (wherein the method can also be referred to as a method for adjusting a hearing system to individual hearing needs and preferences of a specific hearing system user). The method shall not have the disadvantages mentioned above. In addition, the corresponding fitting system shall be provided. And furthermore, the corresponding computer program product and the corresponding computer-readable medium shall be provided.

Another object of the invention is to provide an improved way of fitting a hearing device.

Another object of the invention is to provide a way of fitting a hearing device which provides the user of the fitting system with the feeling of being free to act according to his thoughts and/or to be in complete control of the situation.

Another object of the invention is to provide a way of calmly and thoughtfully fitting a hearing device.

Another object of the invention is to provide a way of fitting a hearing device with little undesired interruptions only.

Another object of the invention is to provide a way of fitting a hearing device which allows a user of the fitting system to handle potential or existing problems or inconsistencies at a time he can choose.

Another object of the invention is to provide a way of fitting a hearing device which allows a user of the fitting system to make decisions at times he can choose.

Another object of the invention is to provide a way of fitting a hearing device facilitating to carry out the fitting in a well-structured way, in particular wherein the fitting process can be largely structured by the user of the fitting system.

Another object of the invention is to provide a way of fitting a hearing device allowing to handle interdependencies in an improved way.

Another object of the invention is to provide a way of fitting a hearing device providing an improved handling of inconsistencies and incompatibilities arising from data inputted by the user of the fitting system.

Another object of the invention is to provide a way of fitting a hearing device providing the user of the fitting system with an improved overview over the fitting process.

Further objects emerge from the description and embodiments below.

At least one of these objects is at least partially achieved by apparatuses and methods according to the patent claims.

The method for manufacturing an adjusted hearing system adjusted to individual hearing needs and preferences of a specific hearing system user by means of a fitting system comprising a visual display, comprises the steps of a) presenting on said visual display a visualization simultaneously visualizing for each of a group of data sets: whether or not the respective data set is accessible to a user of said fitting system; and for each device selected in said fitting system to be part of said hearing system: whether or not the respective device is accessible to a user of said fitting system;

by b1) displaying on said visual display a graphics object representing the respective data set or device, in case the respective data set and the respective device, respectively, is accessible to a user of said fitting system; and b2) not displaying on said visual display a graphics object representing the respective data set or device, in case the respective data set and the respective device, respectively, is not accessible to a user of said fitting system.

That method can also be considered a method for adjusting a hearing system to individual hearing needs and preferences of a specific hearing system user.

The above method provides the user of the fitting system with a valuable overview over the accessible data and devices, respectively. For example, if there is no graphics object concerning audiogram data, the user of the fitting system will understand that he currently does not have access to such audiogram data in the fitting system, and, accordingly, he will understand that it will be impossible to calculate initial-fitting data, since—even if a suitable fitting rationale is available—audiogram data are missing. This was an example with a graphics object representing a data set. The presence of a graphics object representing a device can be helpful, e.g., if a graphics object representing a remote microphone is displayed indicating to the user of the fitting system that he can provide special parameter settings related to a remote microphone.

Note that, usually, the hearing system user is different from the user of the fitting system. But in certain circumstances, said user of said fitting system can be identical with said specific hearing system user.

The term being "accessible to a user of said fitting system" more precisely means being accessible within said fitting system. More particularly, said fitting system comprises a fitting software running on a computer, and the steps a) and b) are carried out by said fitting software, and said being "accessible to a user of said fitting system" means being accessible within said fitting software. Note that not being "accessible" comprises the case that data or devices do exist in the fitting system, but access to said data is denied to a user of the fitting system (via the fitting system, more precisely via said fitting software), wherein furthermore, if some data or a device does exist in the fitting system, it is—with respect to said accessibility—of no importance how the respective data or device got into the fitting system.

The term "device selected in said fitting system to be part of said hearing system" more precisely means that the respective device is registered in the fitting system. E.g., the user of the fitting system can register a device in the fitting system by selecting the device, e.g., from a list of devices. And/or the fitting system (automatically) recognizes devices to which it is connected and registers these. It is not necessary that a device is connected to the fitting system in order to be selected or registered; and a device connected to the fitting system does not necessarily have to be selected or registered; e.g., an automatically registered device could be deselected by the user of the fitting system.

In one embodiment, the method comprises carrying out the step of g) displaying on said visual display information related to the respective data set or device, when a first type of selecting action is applied to a graphics object by means of a selecting tool.

Examples of selecting tools are computer mouse, trackpad, touchscreen.

Said displaying in step g) can be accomplished, e.g., in a drop-down list or an appearing text field.

In one embodiment which may be combined with the before-addressed embodiment, the method comprises carrying out the step of h) displaying on said visual display data of the respective data set or data related to the respective device, or an offer to edit the respective data set or data related to the respective device or the selection of the respective device, when a second type of selecting action is applied to a graphics object by means of a selecting tool.

The displaying may be accomplished, e.g., by opening a corresponding window.

Examples of selecting actions are hovering, single clicking, double clicking, left click, right click.

In one embodiment comprising both, step g) and step h), said first and second types of selecting action are different from each other. Typical combinations of first and second types of selecting action are: first=hovering, and second=single click; first=single click, and second=double click; first=left click, and second=right click.

Such actions provoked by a first and/or a second type of selecting to said graphics object are valuable for the user of the fitting system, because it provides the user of the fitting system with important information and/or gives the user of the fitting software a quick and easy access to important editing possibilities. Note that the user of the fitting system finds access to these possibilities and information, respectively, at the place where the accessibility of the respective data set and device, respectively, is indicated, namely at the respective graphics object. This is most helpful and convenient.

In one embodiment which may be combined with one or more of the before-addressed embodiments, the method comprises, when a change occurs in the fitting system, carrying out the step of c) checking for an incompatibility of said change in the fitting system with at least one of said data sets accessible to a user of the fitting system and/or with at least one of said devices accessible to a user of the fitting system;

and, if at least one such incompatibility is detected for at least one of said data sets or devices, carrying out for each data set and device, respectively, for which such an incompatibility has been detected, the step of d) displaying on said visual display an amended graphics object representing the respective data set or device;

in particular wherein the amendment to the graphics object indicates the incompatibility to the user of the fitting system.

This is a particularly valuable embodiment, since it allows the user of the fitting software to follow his train of thoughts while calmly an indication is given that—at some point, choosable by the user of the fitting system—he should take care of or at least be informed about an incompatibility. And note that, as indicated by the "amended graphics object", the user will readily realize to which data set or device the detected incompatibility is linked, as he recognizes the amended graphics object as a somewhat changed or modified version of the "original" (not-amended) graphics object.

In one embodiment with steps c) and d), these steps are carried out automatically by said fitting system (more particularly by a fitting software of said fitting system).

In one embodiment with steps c) and d), which may be combined with the before-addressed embodiment, said amended graphics object is displayed in at least approximately the same place as the unmodified graphics object was displayed. This provides a particularly clear link to the data set or device with respect to which the incompatibility has occurred.

In one embodiment with steps c) and d), which may be combined with one or more of the before-addressed embodiments with steps c) and d), the amendment to the graphics object comprises or substantially is the addition of an alert symbol, a conflict indicator or an incompatibility indicator to the graphics object.

E.g., a round mark with an exclamation mark may be added to the unamended graphics object, or the graphics object may be amended to appear in a generally reddish color.

In one embodiment with steps c) and d), which may be combined with one or more of the before-addressed embodiments with steps c) and d), in step c), it is checked for an incompatibility of said change in the fitting system with all of said data sets accessible to a user of the fitting system and with all of said devices accessible to a user of the fitting system.

In one embodiment with steps c) and d), which may be combined with one or more of the before-addressed embodiments with steps c) and d), in step c), it is checked for an incompatibility of said change in the fitting system with a predetermined selection of said data sets accessible to a user of the fitting system and/or with a predetermined selection of said devices accessible to a user of the fitting system, in particular wherein said change in the fitting system is a change in one of said data sets accessible to a user of the fitting system or in one of said devices accessible to a user of the fitting system, and wherein said predetermined selection depends on that one data set and device, respectively.

In one embodiment with steps c) and d), which may be combined with one or more of the before-addressed embodiments with steps c) and d), said change in the fitting system is a change in one of said data sets accessible to a user of the fitting system or in one of said devices accessible to a user of the fitting system, wherein in step c), it is not checked for an incompatibility of said change in the fitting system with that one data set and with that one device, respectively.

In one embodiment with steps c) and d), which may be combined with one or more of the before-addressed embodiments with steps c) and d), said change in the fitting system is caused by a user of the fitting system, more particularly, wherein said change in the fitting system is caused by a user of the fitting system changing or editing data in the fitting system. This is a typical case: The user enters, edits or deletes data; the fitting systems checks for incompatibilities and indicates those and the related data set(s) or device(s) by displaying the amended graphics objects.

In one embodiment with steps c) and d), which may be combined with one or more of the before-addressed embodiments with steps c) and d), said change comprises at least one of the group comprising a change in at least one of said data sets;

a change in the accessibility of a data set to a user of said fitting system;

a change in a property of a device selected to be part of the fitting system;

a change in a selection of a device to be part of said hearing system;

a change in the accessibility of a device to said user of said fitting system.

In one embodiment with steps c) and d), which may be combined with one or more of the before-addressed embodiments with steps c) and d), the method comprises carrying out the step of e) displaying on said visual display information descriptive of a cause for said incompatibility, when a first type of selecting action is applied to such an amended graphics object by means of a selecting tool.

In other words, when a first type of selecting is applied to said amended graphics object, the user can readily learn why the incompatibility has occurred.

In one embodiment with steps c) and d), which may be combined with one or more of the before-addressed embodiments with steps c) and d), the method comprises carrying out the step of f) displaying on said visual display an offer for resolving said incompatibility, when a second type of selecting action is applied to such an amended graphics object by means of a selecting tool.

With respect to exemplary embodiments of the selecting tool and of the first and second type of selecting actions, the same applies to the embodiments with steps e) and/or f) as described above in conjunction with steps g) and h).

Said displaying of the information and/or said displaying of said offer, may, e.g., be accomplished by means of a drop-down list.

In one embodiment comprising both, step g) and step h), said first and second types of selecting action are different from one another.

In one embodiment with step f), selecting said offer (e.g., by a mouse click) will cause a change in data in the fitting system, more particularly will cause that at least one data set accessible to a user of the fitting system and/or at least one device accessible to a user of the fitting system is changed, even more particularly is changed such that said incompatibility is resolved.

In one embodiment which may be combined with one or more of the before-addressed embodiments, said group of data sets comprises at least an initial-fitting data set at least comprising data representative of a result of applying a fitting rationale to audiogram data of said specific hearing system user; and a fine-tuning data set at least comprising data representative of parameter adjustments carried out during fine-tuning or parameter settings obtained during fine-tuning.

In one embodiment referring to the before-addressed embodiment, step a) is carried out permanently or quasi-permanently at least during time periods during which at least said initial-fitting data and/or said fine-tuning data are editable in said fitting system by a user of said fitting system. This way, it is ensured that the user of the fitting system can quickly conceive important status information during nearly the whole fitting session from looking at the graphics objects.

In one embodiment which may be combined with one or more of the before-addressed embodiments, step a) is carried out permanently or quasi-permanently during time periods during which at least one data set of said group of data sets is editable in said fitting system by a user of said fitting system.

The "quasi-permanent display of a graphics object" means in one embodiment that the graphics object is permanently displayed, unless it is temporarily covered. In another embodiment, it means that it is permanently displayed, unless a location in said visual display where the respective graphics object is otherwise displayed is temporarily otherwise occupied, e.g., by a pop-up window or a drop-down list. In another embodiment, it means that it is permanently displayed with only occasional interruptions. In another embodiment, it means that it is steadily present (visible, displayed), but only occasionally covered; in particular covered by a dialog box or a pop-up box or the like. In another embodiment, it means that the graphics object is not presented only during processes in which a user of said fitting system is able to enter or edit data. In another embodiment, it means that the graphics object is not presented only during periods having a defined beginning and end and during which said user of said fitting system may enter or edit data. Note that editing comprises deleting.

In one embodiment which may be combined with one or more of the before-addressed embodiments, said group of data sets comprises at least an initial-fitting data set at least comprising data representative of a result of applying a fitting rationale to audiogram data of said specific hearing system user;

a fine-tuning data set at least comprising data representative of parameter adjustments carried out during fine-tuning or parameter settings obtained during fine-tuning; and a user description data set at least comprising data descriptive of properties of said specific hearing system user.

Said data descriptive of properties of said specific hearing system user can comprise, e.g., the specific hearing system user's age; data descriptive of previous experience of said specific hearing system user with a hearing system; data descriptive of a hearing system said specific hearing system user used before, in case said specific hearing system user has previous experience with a hearing system.

In one embodiment referring to the before-addressed embodiment, said group of data sets additionally comprises at least one of the group consisting of an audiogram data set at least comprising audiogram data of said specific hearing system user;

a real-ear measurement data set at least comprising data descriptive of measurement results obtained from measurements taken at or in the ear of said specific hearing system user; and a data logging data set at least comprising data of said hearing system recorded during normal operation of the hearing system when used by said specific hearing system user.

Note that with respect to audiogram data and real-ear measurement data, one can distinguish data concerning the left ear and data concerning the right ear. It is possible that such data exist or are accessible only for one ear of the specific hearing system user.

With respect to data logging data and all the possibilities of what may be included therein, it is referred to the well-known art, e.g., to EP1414271A2, which is herewith incorporated by reference in this application for the purpose of providing further details concerning data logging and data logging data.

Note, by the way that the audiogram data in the audiogram data set do not have to be the same audiogram data as have been used for obtaining the initial-fitting data.

In one embodiment which may be combined with one or more of the before-addressed embodiments, each of said graphics objects comprises a figurative and/or an alphanumerical representation of the respective data set or device.

In one embodiment which may be combined with one or more of the before-addressed embodiments, at least one of said graphics objects visualizes the respective data set itself (i.e. the data in the data set) and the respective device itself, respectively, in particular wherein all of said graphics objects do so. This is very helpful for the user of the fitting system.

In one embodiment which may be combined with one or more of the before-addressed embodiments, the graphics object is (or all of them are) such that it allows to deduce therefrom information about the respective data set and the respective device, respectively. Accordingly, the graphics object points to the respective data set and the respective device, respectively.

In one embodiment which may be combined with one or more of the before-addressed embodiments, the graphics object visualizes the respective data set and the respective device itself, respectively, in such a way that it allows one (namely the user of the fitting system) to infer the values of the respective data set and properties of the respective device, respectively.

Some examples for the latter couple of embodiments: The graphics object of the audiogram data set illustrates the shape of the audiogram curve; a graphics object of a hearing device comprises a picture or figure visualizing the hearing device itself or at least the type of hearing device, such that BTE, ITC, CIC devices are readily distinguished.

In one embodiment which may be combined with one or more of the before-addressed embodiments, the hearing system comprises at least one hearing-aid device. In particular, said method comprises adjusting said hearing-aid device to individual hearing needs and preferences of a specific hearing-aid device user.

In one embodiment which may be combined with one or more of the before-addressed embodiments, said adjusting of the hearing system comprises adjusting frequency- and level-dependent input-output curves of at least one hearing device.

In one embodiment which may be combined with one or more of the before-addressed embodiments, said data sets are parameter setting data sets.

The fitting system comprises a visual display and is a system for adjusting a hearing system to individual hearing needs and preferences of a specific hearing system user. It is structured and configured to carry out the steps of a) presenting on said visual display a visualization simultaneously visualizing for each of a group of data sets: whether or not the respective data set is accessible to a user of said fitting system; and for each device selected in said fitting system to be part of said hearing system: whether or not the respective device is accessible to a user of said fitting system;

by b1) displaying on said visual display a graphics object representing the respective data set or device, in case the respective data set and the respective device, respectively, is accessible to a user of said fitting system; and b2) not displaying on said visual display a graphics object representing the respective data set or device, in case the respective data set and the respective device, respectively, is not accessible to a user of said fitting system.

In one embodiment of the fitting system, the fitting system comprises a fitting software and a computer on which the fitting software is running, wherein said fitting software causes said computer to carry out the mentioned steps.

The invention comprises fitting systems with features of corresponding methods according to the invention, and vice versa.

The advantages of the fitting systems basically correspond to the advantages of corresponding methods and vice versa.

The computer program product comprises program code for causing a computer of a fitting system for adjusting a hearing system to individual hearing needs and preferences of a specific hearing system user to perform the steps of a) presenting on a visual display of said fitting system a visualization simultaneously visualizing for each of a group of data sets: whether or not the respective data set is accessible to a user of said fitting system; and for each device selected in said fitting system to be part of said hearing system: whether or not the respective device is accessible to a user of said fitting system;

by b1) displaying on said visual display a graphics object representing the respective data set or device, in case the respective data set and the respective device, respectively, is accessible to a user of said fitting system; and b2) not displaying on said visual display a graphics object representing the respective data set or device, in case the respective data set and the respective device, respectively, is not accessible to a user of said fitting system.

In one embodiment, said program code is configured to cause said computer to perform the steps of allowing a user of said fitting system to adjust a hearing system to individual hearing needs and preferences of a specific hearing system user.

The invention comprises computer program products with features of corresponding methods according to the invention, and vice versa, and computer program products with features of corresponding fitting systems according to the invention, and vice versa.

The advantages of the computer program products basically correspond to the advantages of corresponding methods and fitting systems, respectively, and vice versa.

The computer-readable medium comprises program code as described in the computer program product above.

Further embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. The described embodiments are meant as examples and shall not confine the invention.

DETAILED DESCRIPTION OF THE INVENTION

Figure 1:
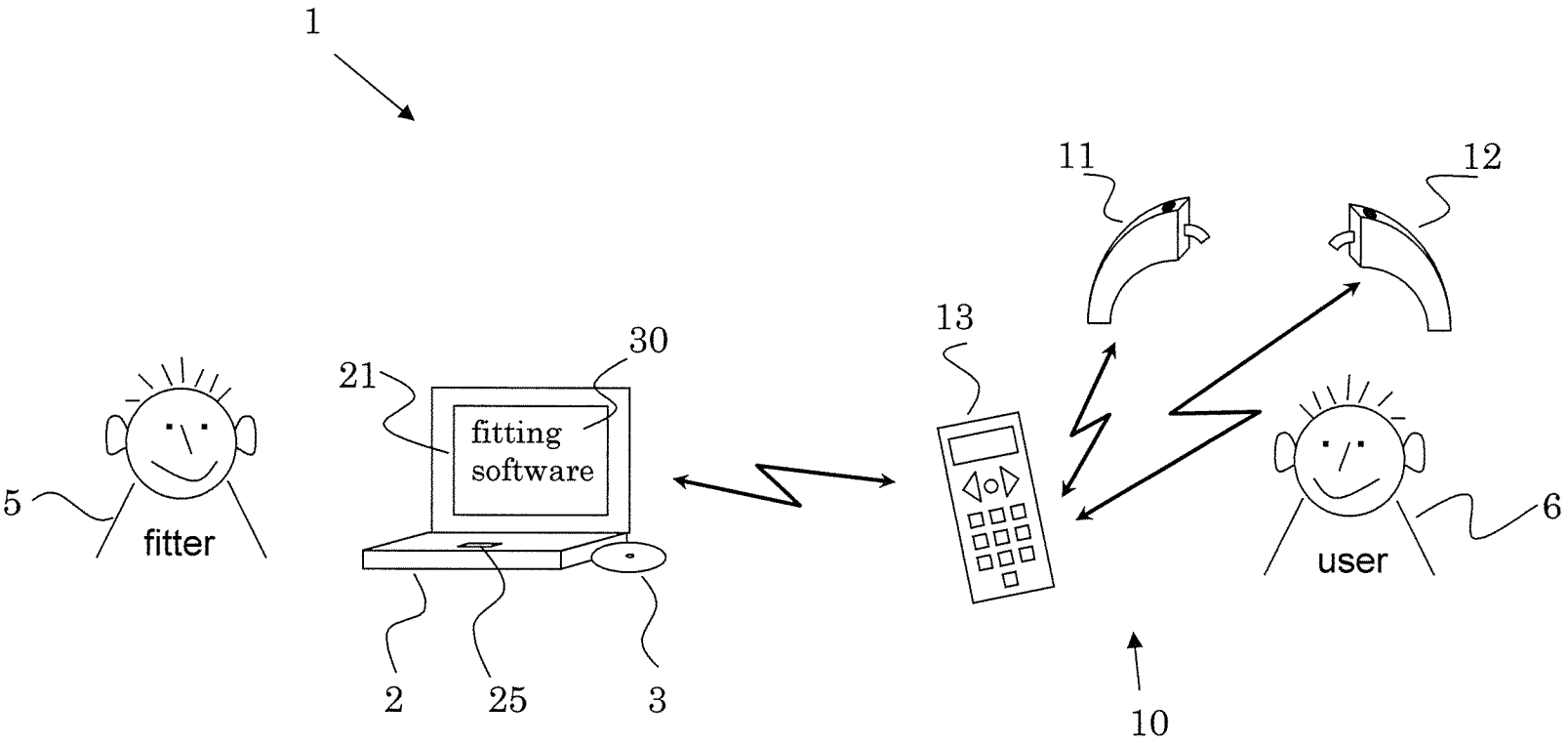
FIG. 1 a diagrammatical illustration of a fitting system.

FIG. 1 shows a diagrammatical illustration of a fitting system 1 for adapting a hearing system 10 to the hearing needs and preferences of a hearing system user 6. The fitting system 1 comprises a computer 2 with a visual display/computer screen 21 and a trackpad 25 and a fitting software 30 running on the computer 2. The fitting software 30 can be stored on a data carrier such as a DVD 3 and can be installed from there on the computer 2.

The computer 2 with the fitting software 30 is operated by a user 5, usually a hearing device professional such as an audiologist, shortly referred to as fitter 5.

The fitting system 1 may furthermore comprise, as shown in FIG. 1, the hearing system 10 which is operationally connected to the computer 2, e.g., wirelessly as shown in FIG. 1, or in a wired fashion. It is nevertheless possible to operate fitting system 1 without a hearing system. E.g., it is possible to simulate hearing devices.

The hearing system 10 comprises a left and a right hearing device 12 and 11, respectively, and a remote control 13.

Figure 2:
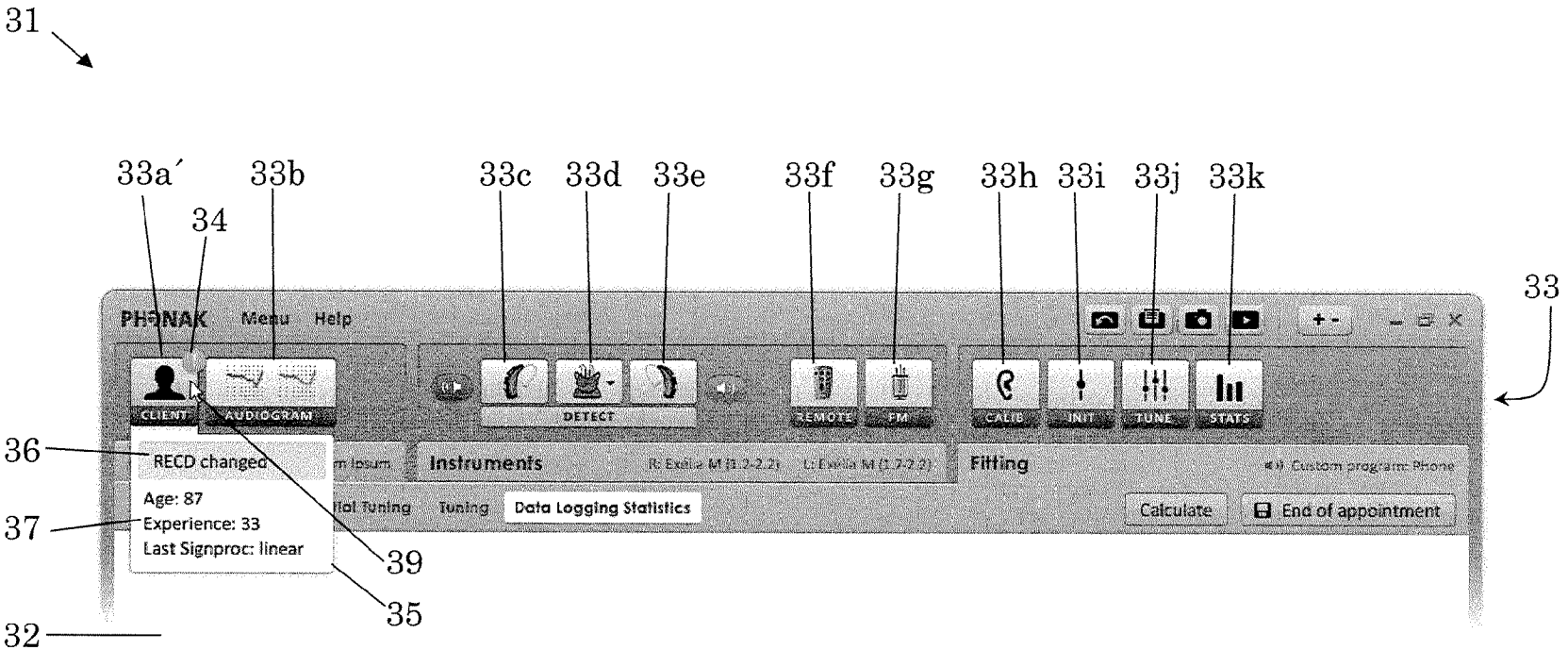
FIG. 2 a detail of a screen shot of a visual display while running the fitting software.
Figure 3:
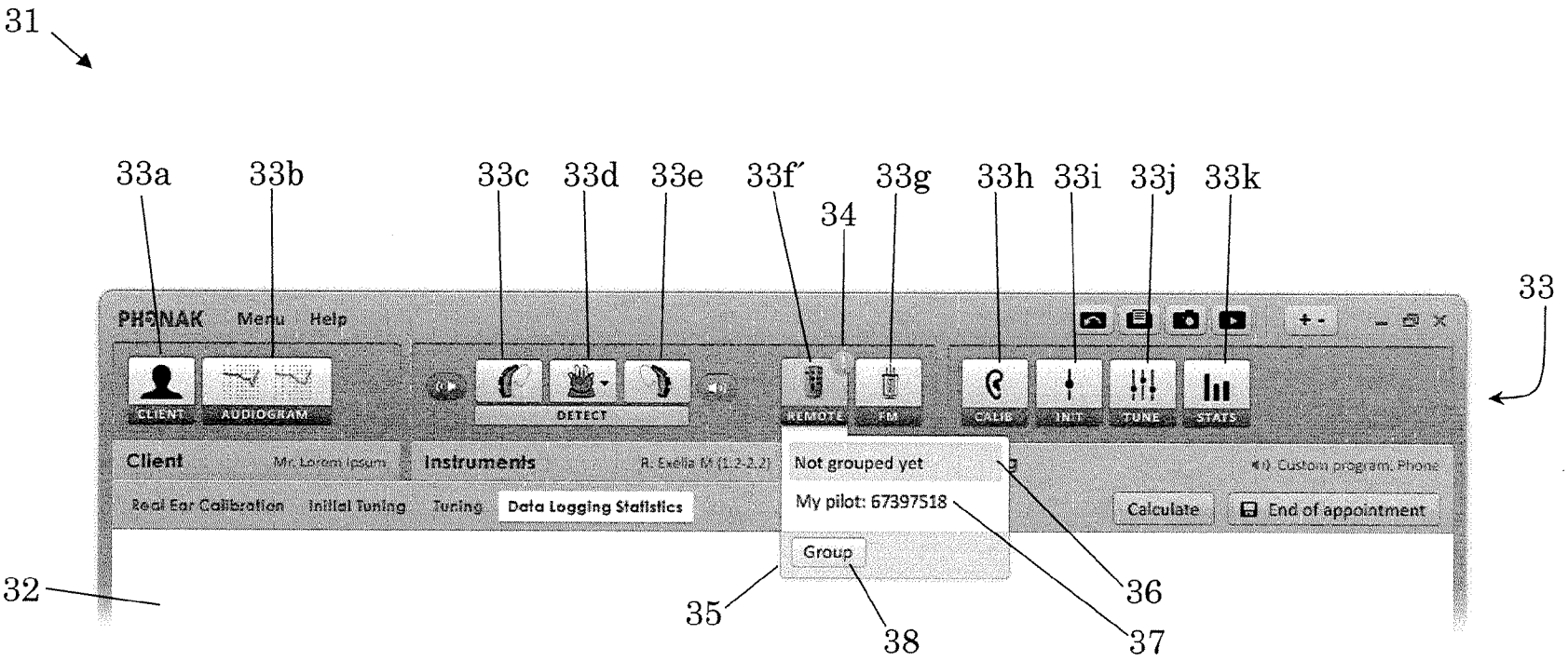
FIG. 3 a detail of a screen shot of a visual display while running the fitting software.
Figure 4:
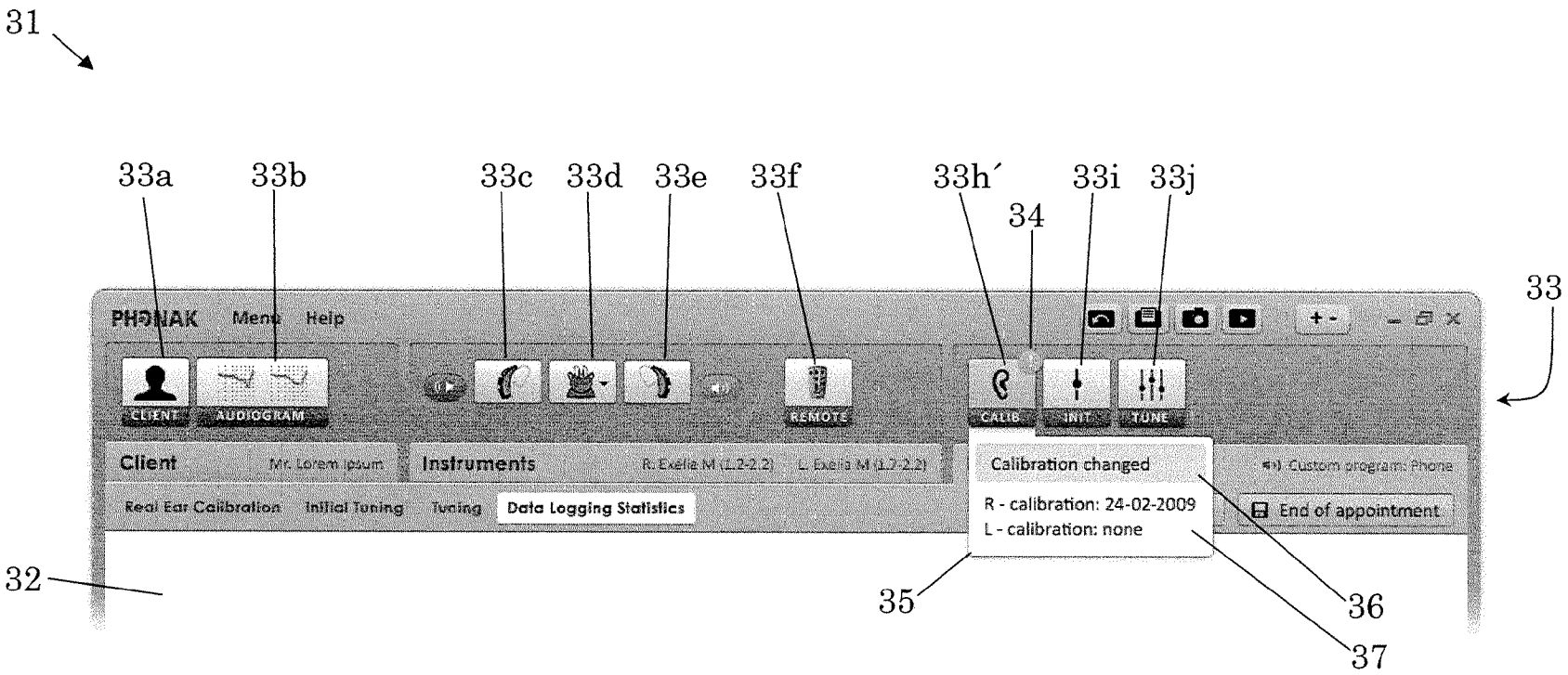
FIG. 4 a detail of a screen shot of a visual display while running the fitting software.

FIGS. 2, 3 and 4 each show a detail of a screen shot of a visual display 21 while running the fitting software 30 on a computer 2. FIGS. 2, 3 and 4 are quite similar, but capture a screen shot in different situations during running the fitting software 30.

Having started the fitting software 30, most operations will be carried out in or from a window 31 displayed on screen 21. From top to bottom (wherein other arrangements are possible, too), window 31 comprises a menu bar, a visualization 33 with several graphic objects 33*a*, 33*b*, 33*c*, . . . , selecting tabs for different topics and—usually bound to the tabs for different topics—a working space or edit area 32. The selecting tabs may comprise further buttons and/or a menu bar. The visualization 33 is of particular importance to the invention.

In visualization 33, several items important for hearing device fitting/hearing system fitting can be visualized. More particularly, it can be visualized in visualization 33 whether or not such an item is accessible to fitter 5 via the fitting software 30. For accessible items, a graphics object 33*a*, 33*b*, . . . is displayed, whereas a corresponding graphics object is not displayed for not-accessible items.

Generally, the "items" can be divided into such referring to devices 11,12,13 of the hearing system 10 and such referring to a data set. In particular:

Graphics object 33*a* refers to a user description data set comprising data descriptive of properties of the specific hearing system user 6, such as the user's age and data characterizing the user's experience with hearing devices so far. A silhouette indicates, that graphics object 33*a* refers to a person (namely the client, i.e. the hearing system user 6), and the letters beneath the silhouette state that graphics object 33*a* refers to data related to the client. If graphics object 33*a* were missing, this would indicate that the corresponding data set is not accessible using the fitting software 30. Preferably, a specific graphics object appears or is missing always in a defined place within window 31. This strongly facilitates to quickly understand the current situation during a fitting session.

With respect to the other graphics objects, things are very similar, so that for reasons of conciseness, not everything will be repeated in the following.

Graphics object 33*b* refers to an audiogram data set comprising audiogram data of said specific hearing system user 6. Note that the accessibility of left-ear and right-ear audiogram data can be visualized separately. Furthermore, in the upper portion of graphics object 33*b*, the respective audiogram data are visualized, i.e. the shape of the left and right audiogram curve, respectively, is depicted there. This is helpful, since it allows to recall peculiarities of the audiograms with only one single quick look anytime (or virtually anytime) during the fitting session.

Graphics object 33*c* refers to the right-ear hearing device 11. It comprises a graphic illustration that allows to distinguish left-ear and right-ear devices and, moreover, types of hearing devices such as BTE, ITC, CIC devices.

Graphics object 33*e* analogously refers to the left-ear hearing device 12.

Graphics object 33*d* refers to a fitting device needed for accomplishing adjustments in physically present devices.

Graphics object 33*f* refers to remote control 13.

Graphics object 33*g* refers to an FM device, e.g., as used for receiving sound in a hearing device via electromagnetic waves.

Note that the device-related graphics objects (33*c*, 33*d*, 33*e*, 33*f*, 33*g*) do not indicate that a device is actually physically present and part of the fitting system 1. It is possible to do hearing device fitting (or at least some details of) without the actual device being present, e.g., using simulations or even without those. A device can just be selected to be part of the fitting system 1, be it manually by user 5 or automatically be the fitting system 1. If the corresponding device data are also accessible in the fitting software 30, the corresponding graphics object will be displayed; otherwise not.

Graphics object 33*h* refers to a real-ear measurement data set comprising data descriptive of measurement results obtained from measurements taken at or in the ear of the specific hearing system user 6. These are data describing the result of test measurements, which are useful to consider during hearing device fitting, such as acoustic transformations or feedback thresholds.

Graphics object 33*i* refers to an initial-fitting data set comprising data representative of a result of applying a fitting rationale to audiogram data of the specific hearing system user 6. Such a data set usually forms the basis for the subsequent fine-tuning. Note that usually, the addressed audiogram data from which the initial fitting data set is derived by applying a fitting rationale are those audiogram data present in the before-mentioned audiogram data set. But it is not necessarily so, e.g., it is possible, that in the audiogram data set, new data are provided, whereas the initial-fitting data currently available in the initial-fitting data set are based one older audiogram data, or vice versa.

Graphics object 33*j* refers to a fine-tuning data set comprising data representative of parameter adjustments carried out during fine-tuning or parameter settings obtained during fine-tuning. If graphics object 33*j* is missing, fitter 5 will know that no fine-tuning data are accessible.

Graphics object 33*k* refers to a data logging data set comprising data of said hearing system 10 recorded during normal operation of the hearing system 10 when used by said specific hearing system user 6. Such data logging data are valuable to have available during fine-tuning. The presence or missing of graphics object 33*k* indicates to fitter 5 whether or not such data logging data are accessible.

Note that it is desirable to have the graphics icons of visualization 33 continuously displayed, preferably with no or not many interruptions. The arrangement of visualization 33 near an outer boarder of window 31 is helpful for achieving that goal. Generally, the graphics icons of visualization 33 should be permanently displayed as long as window 31 is open and of suitable size; and interruptions of the permanence of their visibility should be confined to times at which one or more of the graphics objects is covered, e.g., by a pop-up window or a drop-down list. Preferably, the interruptions should occur at most during tasks having a well-defined beginning and a well-defined end, e.g., a task during which fitting system user 5 edits some data.

During a fitting session, fitter 5 will make changes in the fitting system, usually by means of the fitting software 30. E.g., fitter 5 will select or deselect a device such as device 11 or 12 or 13, or he will edit, delete or add data of a data set, e.g., of a data set related to one of those to which one of the graphics objects of visualization 33 refers. In that case, the fitting software 30 will carry out checks for incompatibility of that change in the fitting system 1 with the other devices and data sets in visualization 33.

If an incompatibility is found, the graphics object referring to the item the change in the fitting system 1 is incompatible with, will be amended. Such "amended graphics objects" have, in FIGS. 2 to 4, a dash added to the reference symbol, and, in the example of FIGS. 2, 3 and 4, there is an alert sign, namely a circle with an exclamation mark, added near the boarder of the unamended graphics symbol.

Fitter 5 can easily see in which place, i.e. with respect to which item, an incompatibility occurs. And, in contrast to a pop-up box or the like that would need an input from the user and interrupt his mental workflow, the user is not interrupted. He can look at visualization 33 whenever he wants and solve the incompatibility problem at a later time of his choice.

And moreover, hovering the trackpad-driven cursor 39 over the amended graphics object 33*a*' (cf. FIG. 2), the fitter 5 will be provided with information 36 descriptive of a cause for an incompatibility which is comprised in an information display 35 coming up upon said hovering. In addition, the information display 35 will also provide further information related to the respective data set or device, i.e. in the case of FIG. 2, further information related to the hearing system user 6. Information of the latter kind (information related to the respective data set or device) is displayed in an information display 35 coming up when hovering over a graphics object that is (currently) not amended.

The same applies to other items when hovering over the respective graphics object.

In FIG. 3, a change has been carried out in the fitting system 1 that caused an incompatibility with remote control 13, namely in that remote control 13 is not grouped yet, wherein not being grouped means in this context that remote control 13 is not yet capable of properly functioning together with other devices of the hearing system, e.g., because certain data still need to be saved in remote control 13 or certain data are not yet synchronized with data in at least one other device of the hearing system.

The alert symbol 34 indicates the occurrence of an incompatibility with respect to remote control 13, and hovering over the amended graphics symbol 34*f*' will result in the display of an information display 35 not only explaining the cause of the incompatibility (information 36) and general information 37 about remote control 13, but also presents an offer 38 that is expected be able to remedy the incompatibility.

If fitter 5 selects that offer 38, e.g., by clicking it with his selecting tool 25, the corresponding action will be carried out and, if successful, the formerly amended graphics symbol 33*f*' will be replaced by not-amended graphics symbol 33*f* again.

In FIG. 4, it is indicated by amended graphics object 33*h*' that an incompatibility has occurred with respect to the real-ear measurement data set. It is informed in 35 that the problem is caused by a changed calibration, and that currently right-ear calibration data of Feb. 24, 2009 are accessible, whereas no left-ear calibration data are accessible.

Note that in FIG. 4, no graphics object 33*g* is shown which allows the user 5 of the fitting system 1 to recognize that no FM device is accessible in fitting system 1, rendering the adjustment of FM device parameter settings superfluous. And no graphics object 33*k* is comprised in visualization 33 of FIG. 4. This is, analogously, a great indicator of the non-availability of logging data to the fitter 5 in the fitting system 1.

Instead of adding the alert symbol 34 as shown in FIGS. 2, 3 and 4, it would also be possible to indicate the presence of an incompatibility in a different way, e.g., by change the color of the graphics object, e.g., to a reddish tone, or to let that graphics symbol flash or the like.

A trackpad-click (or mouse-click) on a graphics object (amended or not) will usually allow to look at and/or edit the respective item (data set, device selection . . . ), e.g., opening a corresponding display or window in working space 32.

Figure 5:
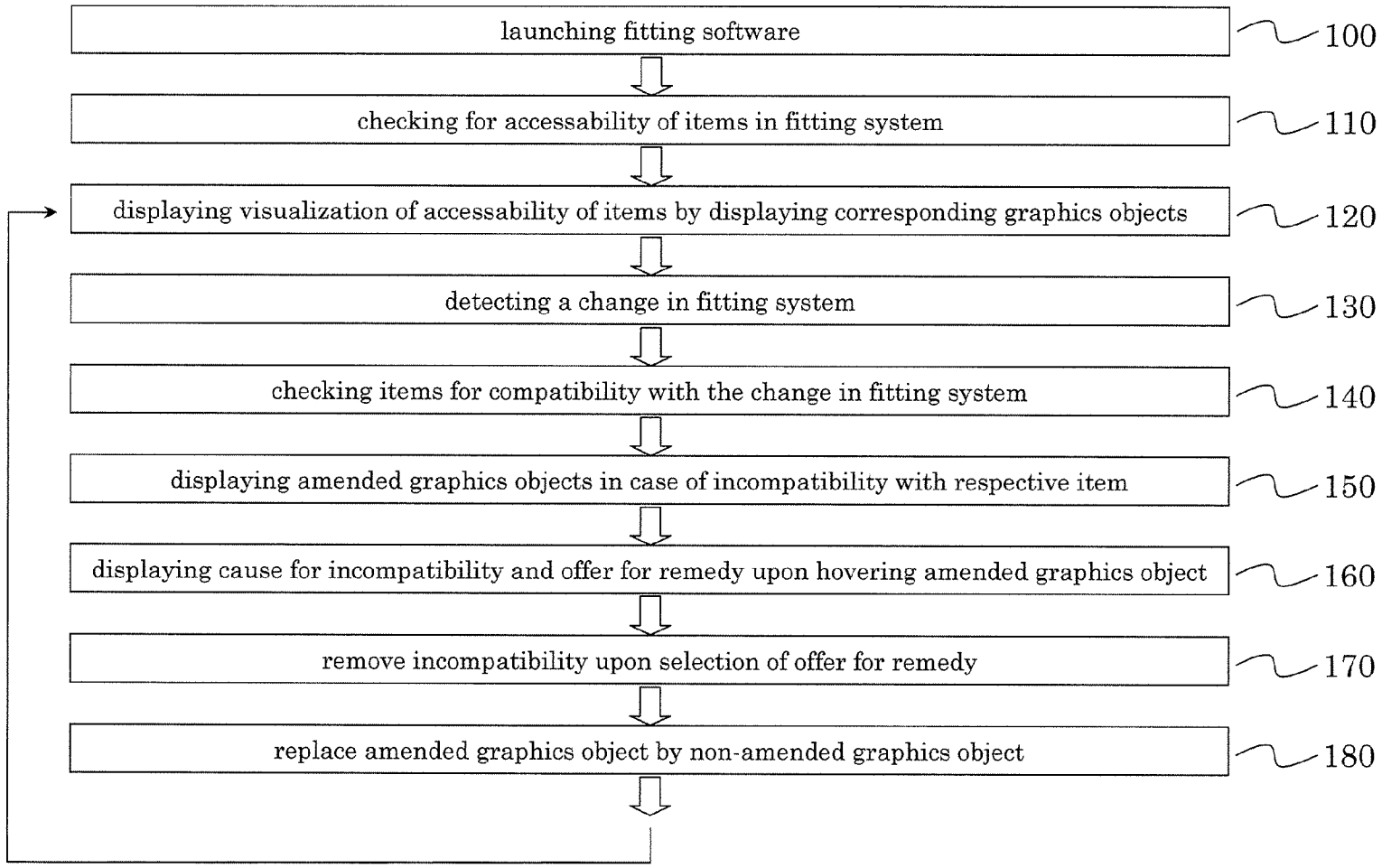
FIG. 5 a sequence of method steps illustrating the method.

FIG. 5 shows a sequence of method steps illustrating the method for fitting a hearing system 10. The steps 100 to 180 are self-explaining. Only a relatively simple sequence of steps is illustrated in FIG. 5. The steps 110 to 180 are preferably all carried out automatically by fitting system 1, more particularly by fitting software 30 running on computer 2, wherein in step 170, further input from user 5 of fitting system 1 may be needed.

The described graphics environment with the visualization 33, and in particular with the amended graphics objects provides a great help to a fitter in terms of being able to work calmly and thoughtfully during a fitting session.

LIST OF REFERENCE SYMBOLS

1 fitting system
2 computer system, computer
3 computer-readable medium, data carrier, CD, DVD
5 user of fitting system
6 hearing system user
10 hearing system
11 hearing device
12 hearing device
13 remote control
21 visual display, monitor, computer screen
25 selecting tool, trackpad
30 fitting software
31 window
32 working space, edit area
33*a*, 33*b*, 33*c*, . . . graphics object, icon, tile
33*a*', 33*f*', 33*h*' amended graphics object
34 alert symbol, incompatibility indicator
35 information display, drop-down list
36 information, information descriptive of a cause for an incompatibility
37 information, information related to the respective data set or device
38 offer, offer for resolving an incompatibility
39 pointer, cursor
100, . . . , 180 steps

What is claimed is:

1. A method for manufacturing an adjusted hearing system (10) adjusted to individual hearing needs and preferences of a specific hearing system user (6) by means of a fitting system (1) comprising a visual display (21), said method comprising the steps of:

a) presenting on said visual display (21) a visualization (33) simultaneously visualizing information about a plurality of hearing devices connected to, and registered in, the fitting system (1) and a plurality of data sets representing characteristics of a plurality of specific hearing system users (6), each data set including data related to the specific hearing system user (6) of each hearing device:

for each of a group of data sets: whether the respective data set is accessible to a user (5) of said fitting system (1); and for each device selected in said fitting system (1) to be part of said hearing system (10): whether the respective device (11; 12; 13) is accessible to a user (5) of said fitting system (1);

by b1) displaying on said visual display (21) a graphics object (33*a*, 33*b*, . . . ) representing the respective data set or device (11; 12; 13), in case the respective data set or device is accessible to a user (5) of said fitting system (1); and b2) not displaying on said visual display (21) a graphics object (33*a*, 33*b*, . . . ) representing the respective data set or device (11; 12; 13), in case the respective data set or device is not accessible to a user (5) of said fitting system (1), wherein the graphics object (33*a*, 33*b*, . . . ) represents one of the data sets.

2. A method for manufacturing an adjusted hearing system (10) adjusted to individual hearing needs and preferences of a specific hearing system user (6) by means of a fitting system (1) comprising a visual display (21), said method comprising the steps of:

a) presenting on said visual display (21) a visualization (33) simultaneously visualizing:

for each of a group of data sets: whether the respective data set is accessible to a user (5) of said fitting system (1); and for each device selected in said fitting system (1) to be part of said hearing system (10): whether the respective device (11; 12; 13) is accessible to a user (5) of said fitting system (1);

by b1) displaying on said visual display (21) a graphics object (33*a*, 33*b*, . . . ) representing the respective data set or device (11; 12; 13), in case the respective data set or device is accessible to a user (5) of said fitting system (1);

b2) not displaying on said visual display (21) a graphics object (33*a*, 33*b*, . . . ) representing the respective data set or device (11; 12; 13), in case the respective data set or device is not accessible to a user (5) of said fitting system (1), and when a change occurs in the fitting system (1), carrying out the step of c) checking for an incompatibility of said change in the fitting system (1) with at least one of said data sets accessible to a user (5) of the fitting system (1) and/or with at least one of said devices (11; 12; 13) accessible to a user (5) of the fitting system (1);

and, if at least one such incompatibility is detected for at least one of said data sets or devices (11; 12; 13), carrying out for each data set and device (11; 12; 13), respectively, for which such an incompatibility has been detected, the step of d) displaying on said visual display (21) an amended graphics object (33*a*'; 33*f*; 33*h*') representing the respective data set or device (11;12;13).

3. The method according to claim 2, wherein the amended graphics object (33*a*; 33*b*; . . . ) comprises the addition of at least one of an alert symbol (34), a conflict indicator, and an incompatibility indicator to the graphics object.

4. The method according to claim 2, wherein in step c), it is checked for an incompatibility of said change in the fitting system (1) with a predetermined selection of said data sets accessible to a user (5) of the fitting system (1) and/or with a predetermined selection of said devices (11; 12; 13) accessible to a user (5) of the fitting system (1), and wherein said change in the fitting system (1) is a change in one of said data sets accessible to a user (5) of the fitting system (1) or in one of said devices (11; 12; 13) accessible to a user (5) of the fitting system (1), and wherein said predetermined selection does not comprise that one data set and that one device (11; 12; 13), respectively.

5. The method according to claim 2, wherein said change in the fitting system (1) is caused by a user (5) of the fitting system (1).

6. The method according to claim 2, wherein said change comprises at least one of the group comprising:

a change in at least one of said data sets;

a change in the accessibility of a data set to a user (5) of said fitting system (1);

a change in a property of a device (11; 12; 13) selected to be part of the fitting system (1);

a change in a selection of a device (11; 12; 13) to be part of said hearing system (1); and a change in the accessibility of a device (11; 12; 13) to said user (5) of said fitting system (1).

7. The method according to claim 2, comprising carrying out the step of e) displaying on said visual display (21) information (36) descriptive of a cause for said incompatibility, when a first type of selecting action is applied to such an amended graphics object (33*a*'; 33*f*'; 33*h*') by means of a selecting tool (25).

8. The method according to claim 7, comprising carrying out the step of f) displaying on said visual display (21) an offer (38) for resolving said incompatibility, when a second type of selecting action is applied to such an amended graphics object (33*a*'; 33*f*'; 33*h*') by means of a selecting tool (25).

9. The method according to claim 1, wherein said group of data sets comprises at least:

an initial-fitting data set at least comprising data representative of a result of applying a fitting rationale to audiogram data of said specific hearing system user (6); and a fine-tuning data set comprising at least one of parameter settings obtained during fine-tuning and data representative of parameter adjustments carried out during fine-tuning.

10. The method according to claim 9, wherein step a) is carried out at least quasi-permanently at least during time periods during which at least one of said initial fitting data and said fine-tuning data are editable in said fitting system by a user (5) of said fitting system (1).

11. The method accoding to claim 1, wherein said group of data sets comprises at least an initial-fitting data set at least comprising data representative of a result of applying a fitting rationale to audiogram data of said specific hearing system user;

a fine-tuning data set at least comprising one of parameter settings obtained during fine-tuning and data representative of parameter adjustments carried out during fine-tuning; and a user description data set at least comprising data descriptive of properties of said specific hearing system user (6).

12. The method according to claim 11, said group of data sets additionally comprising at least one of the following:

an audiogram data set at least comprising audiogram data of said specific hearing system user (6);

a real-ear measurement data set at least comprising data descriptive of measurement results obtained from measurements taken at or in the ear of said specific hearing system user (6); and a data logging data set at least comprising data of said hearing system (10) recorded during normal operation of the hearing system (10) when used by said specific hearing system user (6).

13. The method according to claim 1, wherein each of said graphics objects (33*a*; 33*b*; . . . ) comprises at least one of a figurative and an alphanumerical representation of the respective data set or device (11; 12; 13).

14. The method according to claim 2, wherein at least one of said graphics objects (33*a*; 33*b*; . . . ) visualizes the respective data set and the respective device.

15. A fitting system (1), comprising a visual display (21), for adjusting a hearing system (10) to individual hearing needs and preferences of a specific hearing system user (6), which is structured and configured to carry out the steps of:

a) presenting on said visual display (21) a visualization (33) simultaneously visualizing information about a plurality of hearing devices connected to, and registered in, the fitting system (1) and a plurality of data sets representing characteristics of a plurality of specific hearing system users (6), each data set including data related to the specific hearing system user (6) of each hearing device:

for each of a group of data sets: whether the respective data set is accessible to a user (5) of said fitting system (1); and for each device (11; 12; 13) selected in said fitting system (1) to be part of said hearing system (10): whether the respective device (11; 12; 13) is accessible to a user (5) of said fitting system (1);

by b1) displaying on said visual display (21) a graphics object (33*a*; 33*b*; . . . ) representing the respective data set or device (11; 12; 13), in case the respective data set or device is accessible to a user (5) of said fitting system (1); and b2) not displaying on said visual display (21) a graphics object (33*a*; 33*b*; . . . ) representing the respective data set or device (11; 12; 13), in case the respective data set or device is not accessible to a user (5) of said fitting system (1), wherein the graphics object (33*a*, 33*b*, . . . ) represents one of the data sets.

16. A computer program product (30) comprising program code for causing a computer (2) of a fitting system (1) for adjusting a hearing system (10) to individual hearing needs and preferences of a specific hearing system user (6) to perform the steps of:

a) presenting on a visual display (21) of said fitting system (1) a visualization (33) simultaneously visualizing information about a plurality of hearing devices connected to, and registered in, the fitting system (1) and a plurality of data sets representing characteristics of a plurality of specific hearing system users (6), each data set including data related to the specific hearing system user (6) of each hearing device:

for each of a group of data sets: whether the respective data set is accessible to a user (5) of said fitting system (1); and for each device (11; 12; 13) selected in said fitting system (1) to be part of said hearing system (10): whether the respective device is accessible to a user (5) of said fitting system (1);

by b1) displaying on said visual display (21) a graphics object (33*a*; 33*b*; . . . ) representing the respective data set or device (11; 12; 13), in case the respective data set or device is accessible to a user (5) of said fitting system (1); and b2) not displaying on said visual display (21) a graphics object (33*a*; 33*b*; . . . ) representing the respective data set or device (11; 12; 13), in case the respective data set or device is not accessible to a user (5) of said fitting system (1), wherein the graphics object (33*a*, 33*b*, . . . ) represents one of the data sets.

17. The computer program according to claim 16, wherein the computer program is stored in a computer-readable medium (3).

18. The method according to claim 2, wherein an amendment to the graphics object (33*a*; 33*b*; . . . ) indicates incompatibility to the user (5) of the fitting system (1).

19. The method according to claim 2, wherein all of said graphics objects (33*a*; 33*b*; . . . ) visualize the respective data set and the respective device.

* * * * *